US006937110B2

(12) United States Patent
Ranfagni et al.

(10) Patent No.: US 6,937,110 B2
(45) Date of Patent: Aug. 30, 2005

(54) VARIABLE CUT OFF ATTENUATOR FOR RECTANGULAR WAVE-GUIDES

(75) Inventors: Anedio Ranfagni, Florence (IT); Pasquale Fabeni, Florence (IT); Gian Paolo Pazzi, Florence (IT); Daniela Mugnai, Florence (IT)

(73) Assignee: Consiglio Nazionale Delle Ricerche, Rome (IT)

( * ) Notice: Subject to any disclaimer, the term of this patent is extended or adjusted under 35 U.S.C. 154(b) by 66 days.

(21) Appl. No.: 10/343,960

(22) PCT Filed: Aug. 7, 2001

(86) PCT No.: PCT/IT01/00437

§ 371 (c)(1),
(2), (4) Date: Feb. 5, 2003

(87) PCT Pub. No.: WO02/15322

PCT Pub. Date: Feb. 21, 2002

(65) Prior Publication Data

US 2003/0184406 A1 Oct. 2, 2003

(30) Foreign Application Priority Data

Aug. 14, 2000 (IT) ..... F12000A0180

(51) Int. Cl.[7] ..... H01P 1/22

(52) U.S. Cl. ..... 333/81 B; 333/248

(58) Field of Search ..... 333/81 B, 248, 333/157, 159

(56) References Cited

U.S. PATENT DOCUMENTS

| | | | | | |
|---|---|---|---|---|---|
| 2,197,123 | A | | 4/1940 | King | 333/81 B |
| 2,407,267 | A | * | 9/1946 | Ginzton | 333/81 B |
| 2,411,553 | A | * | 11/1946 | Ramo | 324/95 |
| 2,427,098 | A | | 9/1947 | Keizer | 333/81 B |
| 2,557,110 | A | * | 6/1951 | Jaynes | 333/81 B |
| 2,659,870 | A | | 11/1953 | Laemmel | 333/81 B |
| 2,666,183 | A | * | 1/1954 | Ocnaschek | 333/81 B |
| 2,672,591 | A | * | 3/1954 | Wallauschek | 333/81 B |
| 3,792,385 | A | * | 2/1974 | Napoli et al. | 333/224 |

* cited by examiner

*Primary Examiner*—Stephen E. Jones
(74) *Attorney, Agent, or Firm*—McGlew and Tuttle, P.C.

(57) ABSTRACT

The attenuator includes two variable-section components (13, 15) for the passage, in conditions of perfect adaptation, from a first wave-guide in the P band to a second wave-guide in the X band and vice versa. An air-filled zone (5V), the length of which can be varied in function of the desired attenuation, is situated between the two variable-section components.

11 Claims, 4 Drawing Sheets

VARIABLE CUT OFF ATTENUATOR FOR RECTANGULAR WAVE-GUIDES

FIELD AND BACKGROUND OF THE INVENTION

The present invention refers to an attenuator for wave-guides and, more in particular, a so-called "cut-off" attenuator, i.e. a non-dissipative attenuator with working frequencies below the cut-off frequency.

Rectangular wave-guides, that is to say those created in the form of hollow components with a rigid rectangular cross-section along which the microwaves propagate, are currently used in various applications. To create cut-off attenuators for this type of wave-guide, cables placed between two portions of rectangular wave-guide are currently used. This is complicated from a constructional point of view. In particular, a double guide-cable transition is required. For a description of this technique, refer to F. E. Terman "Electronic and Radio Engineering", (McGraw Hill, New York, 1995, page 154).

In other forms of realization, the attenuator is composed of a plate that is inserted into the rectangular wave-guide. These attenuators also exhibit certain drawbacks known to the experts in this field.

SUMMARY OF THE INVENTION

The object of this invention is the realization of an attenuator for rectangular wave-guides and, in particular, a cut-off attenuator that eliminates the drawbacks of currently known attenuators.

In essence, the attenuator in accordance with the invention includes: a first adapter with a first, variable-section component for the passage, in conditions of perfect adaptation, from a first wave-guide in a first band to a second wave-guide in a second band, and a second adapter with a second variable-section component for the passage, in conditions of perfect adaptation, from said second wave-guide to a third wave-guide in said first band. Characteristically, the invention also prescribes that the first and second variable-section components are positioned in a manner such that they can slide within the second wave-guide and that the first and second variable-section components are mobile with respect to each other, allowing an empty part of longitudinally variable length to be defined between them in the second wave-guide.

The adapters for the passage from one wave-guide to another in conditions of perfect adaptation are described, for example, in IT-B-1253098 (application N° FI91A305), although the possibility of using these adapters in an attenuator is not mentioned.

In a practical form of embodiment, the variable-section components each respectively present an initial, pyramidal portion extending towards said first and said third wave-guides and a portion with a prismatic section corresponding to the section of the second wave-guide, the prismatic portions terminating with their respective bases orthogonal to the longitudinal axis of said second wave-guide.

Additional advantageous characteristics and forms of embodiment of the attenuator in accordance with the invention are indicated in the dependent claims.

BRIEF DESCRIPTION OF THE DRAWINGS

The invention will be better understood by referring to the description and accompanying drawing, which illustrates a practical non limiting example of said invention. In the drawing.

DESCRIPTION OF TEE PREFERRED EMBODIMENTS

Figure 1:
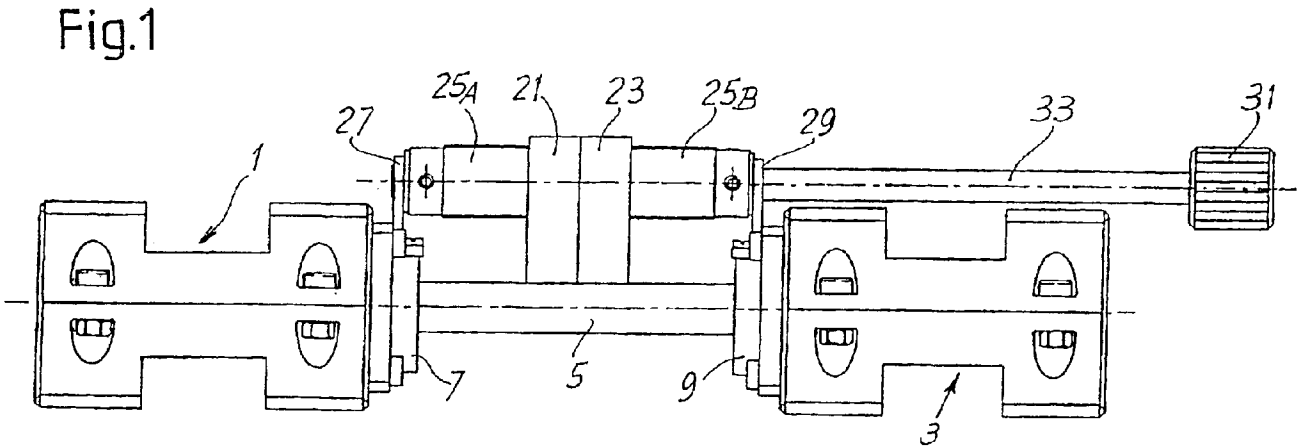
FIG. 1 illustrates an external view of the attenuator in accordance with the invention.
Figure 2:
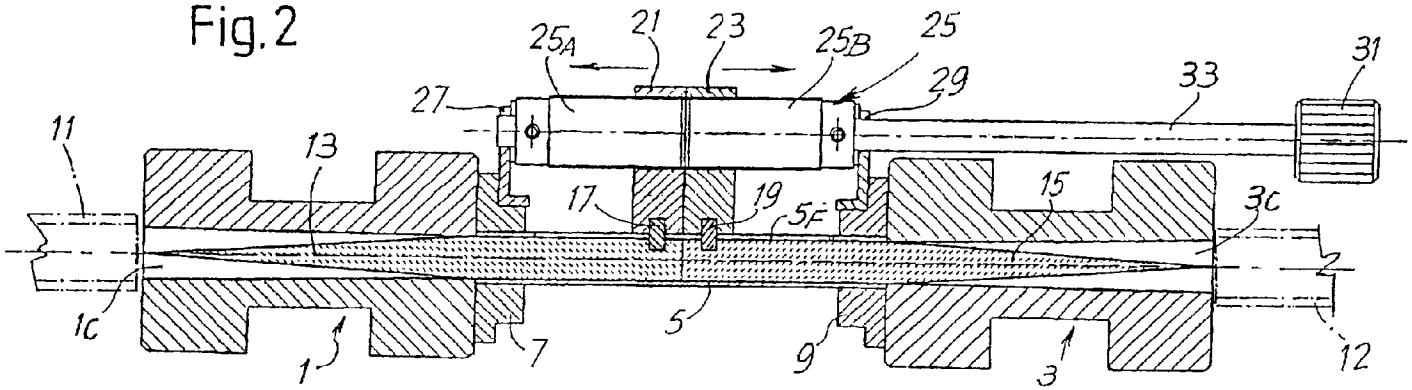
FIGS. 2 and 3 illustrate a longitudinal section of the attenuator in two different set-ups, FIGS. 3A and 3B respectively illustrate a cross-sectional and a frontal view of one of the variable-section components along the lines IIIA—IIIA and IIIB—IIIB of FIG. 3.
Figure 3:
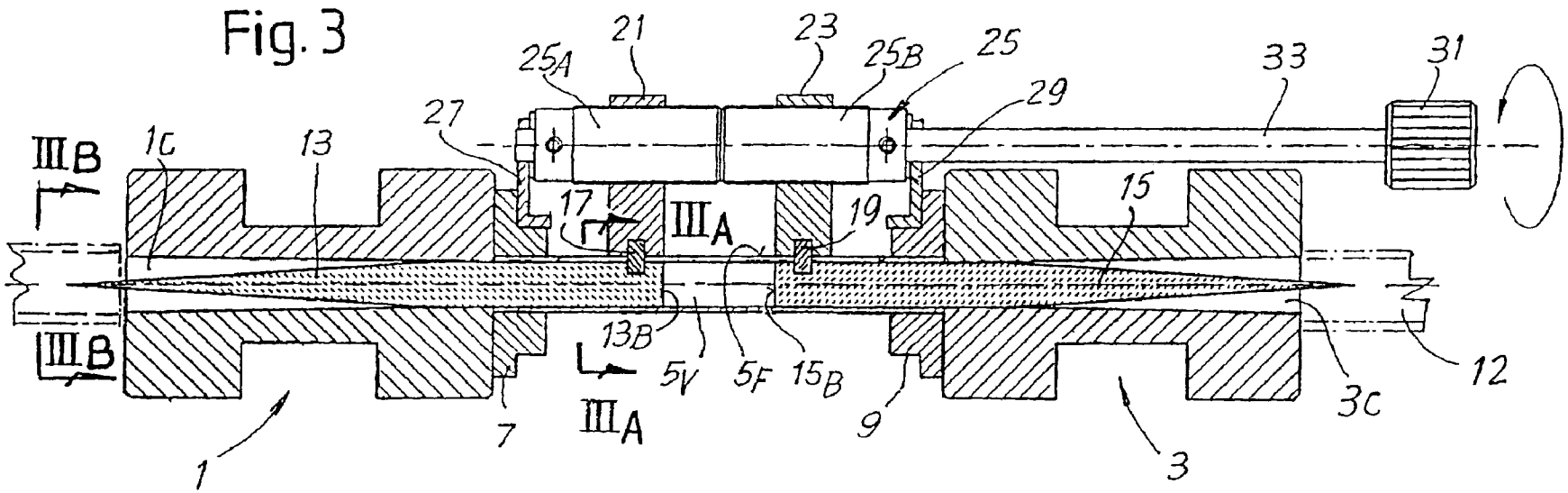

The structure of the attenuator in a possible form of embodiment is illustrated in detail in FIGS. 1 to 3. It presents two terminal connectors, indicated as 1 and 3, joined together via a P-band wave-guide indicated as 5, the ends of which are connected to the inner portions of the connections 1 and 3 via flanges 7 and 9 respectively. Frontally, the connectors 1 and 3 are associated with a first wave-guide in the X band, shown with a dot-dash line and indicated as 11, and another wave-guide in the X band, shown with a dot-dash line and indicated as 12. As is known, wave-guides in the P and X bands have a rectangular section with sides of different proportions. To connect each X-band wave-guide 11 and 12 with the P-band wave-guide 5, the terminal connectors 1 and 3 both have a respective cavity 1C and 3C, with a variable rectangular section that changes between the entrance and exit of the connector, i.e. between the guides 11 or 12 in the X band and the guide 5 in the P band.

Figure 3B:
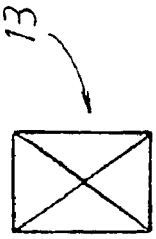
Figure 3A:
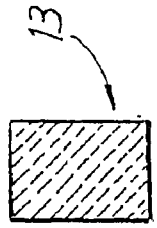

A first component having a variable section, made of Teflon® for example, extends inside connector 1 and has a pyramidal portion, the base of which merges into a prismatic portion with a terminal base 13B (see detail in FIG. 3). The shape of the component 13 is also shown in detail in the sectional view in FIG. 3A and the frontal view in FIG. 3B.

A second component 15, with the same variable section extends inside the terminal connector 3, where it is symmetrically positioned with respect to component 13 such that its base 15B faces the base 13B of component 13. The rectangular-section prismatic portions of the two, variable-section components 13 and 15 extend inside the wave-guide 5 placed between the terminal connectors 1 and 3.

Each of the variable-section components 13 and 15 is connected via a tongue, a key or some other connection member, schematically indicated as 17 and 19, to a respective slider 21 and 23. The means of connection 17 and 19 pass through a longitudinal slot 5F made in the wave-guide 5. The sliders 21 and 23 have threaded holes passing side-to-side that engage with the threaded portions 25A and 25B, which are threaded in opposite directions, of a threaded rod 25 supported by brackets 27 and 28 on the terminal connectors 1 and 3. The threaded rod 25 can be manually rotated via a knob 31, solidly fixed to the rod via a shaft 33. Turning the knob 31 in one direction or the other results in the variable-section components 13 and 15 sliding close together as shown in FIG. 2 or further apart, with the base surfaces 13B and 15B separated from each other by an empty space 5V inside the rectangular guide 5. The longitudinal dimension of the empty space 5V can be adjusted by turning the knob 31 to move the variable-section components 13 and 15 further apart or closer together.

Varying the longitudinal dimension of the empty space 5V, and hence the distance between the variable-section components 13 and 15 gives rise to a variable attenuation of the impulse that is transmitted along the wave-guides 11, 5 and 12.

Figure 4:
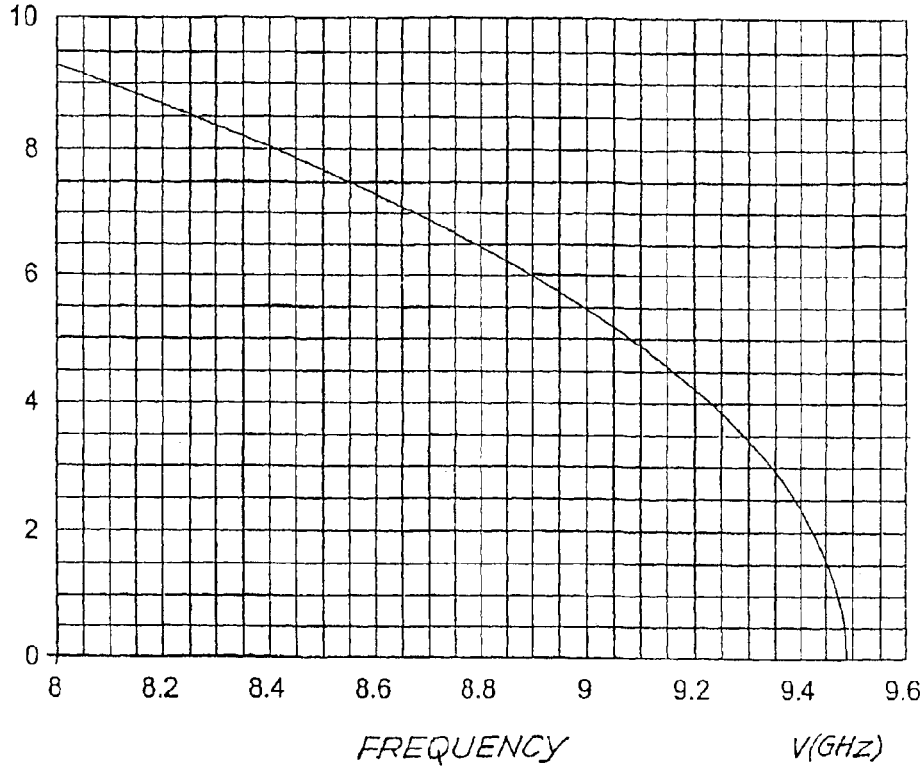
FIG. 4 illustrates the theoretical attenuation curve.

For a P-band guide (9.494 GHz cut-off frequency) and frequency range of 8 to 9.49 GHz, the theoretical attenuation per unit length (cm) varies between 9.2 and 0 db respectively. This attenuation, expressed in db, is the result of the formula (refer to F. E. Terman "Electronic and Radio Engineering", McGraw Hill, New York, 1995, page 153):

$$\alpha\ (\text{db}) = (54.6/\lambda_c)\sqrt{1-(\nu/\nu_c)^2} \tag{1}$$

where the cut-off frequency $\nu_c$ is expressed in GHz and the cut-off wavelength in cm is given by $\lambda_c=30/\nu_c$. FIG. 4 shows this theoretical attenuation curve, with the frequency in GHz on the horizontal axis and the attenuation per unit length on the vertical axis. Theoretically, therefore, in the above described attenuator, an attenuation is obtained that depends on the propagated wave frequency and which is equal to the ordinate value on the diagram in FIG. 4 multiplied by the length of the empty space 5V, i.e. by the distance between the two surfaces 13B and 15B.

Nevertheless, Equation 1 is only valid if the coefficient of transmission T is bound to the attenuation by the formula:

$$T=exp(-\alpha) \tag{2}$$

which is only valid at the limit for large $\alpha$ values. More precisely, the coefficient of transmission is given by:

$$T=[1+exp(\alpha)]^{-1} \tag{3}$$

Thus, at the cut-off ($\nu=\nu_c$), the real attenuation $\alpha_\nu$, which is bound to the coefficient of transmission by the relation $$\alpha_\nu(db)=10\ \log(T^{-1}) \tag{4}$$

is not zero but 3 db (since the coefficient of transmission is ½ and not 1). Thus, the real attenuation curve is found to be that indicated by the dashed line in FIG. 5, which also shows the measurements taken. Each data point, with relative error, is derived from a series of attenuation measurements in function of the length of the attenuating zone 5V for a given frequency. FIG. 6 shows the results of these measurements for a wave frequency of 8.59 GHz propagated through the wave-guides 11, 5 and 12. The distance between the surfaces 13B and 15B is shown in mm on the horizontal axis, while the attenuation in db is shown on the vertical axis.

Figure 5:
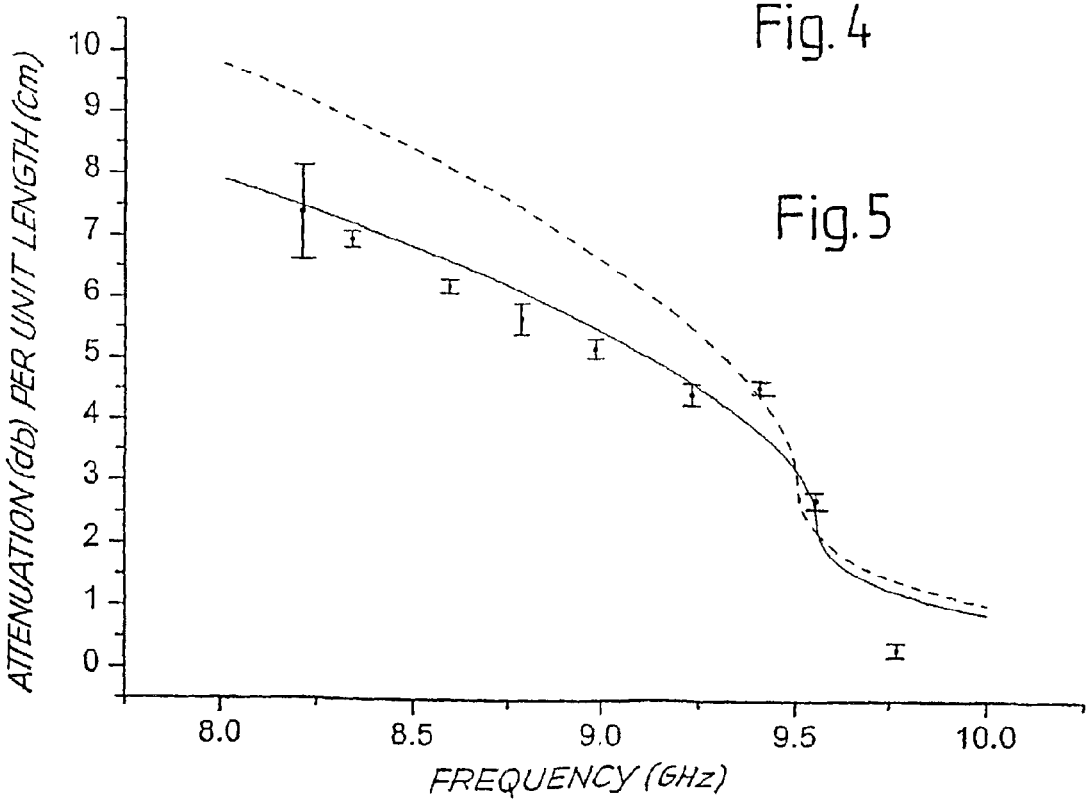
FIG. 5 illustrates the real attenuation curve, and FIG. 6 lists the experimental data acquired for constructing the curve FIG. 5.
Figure 6:
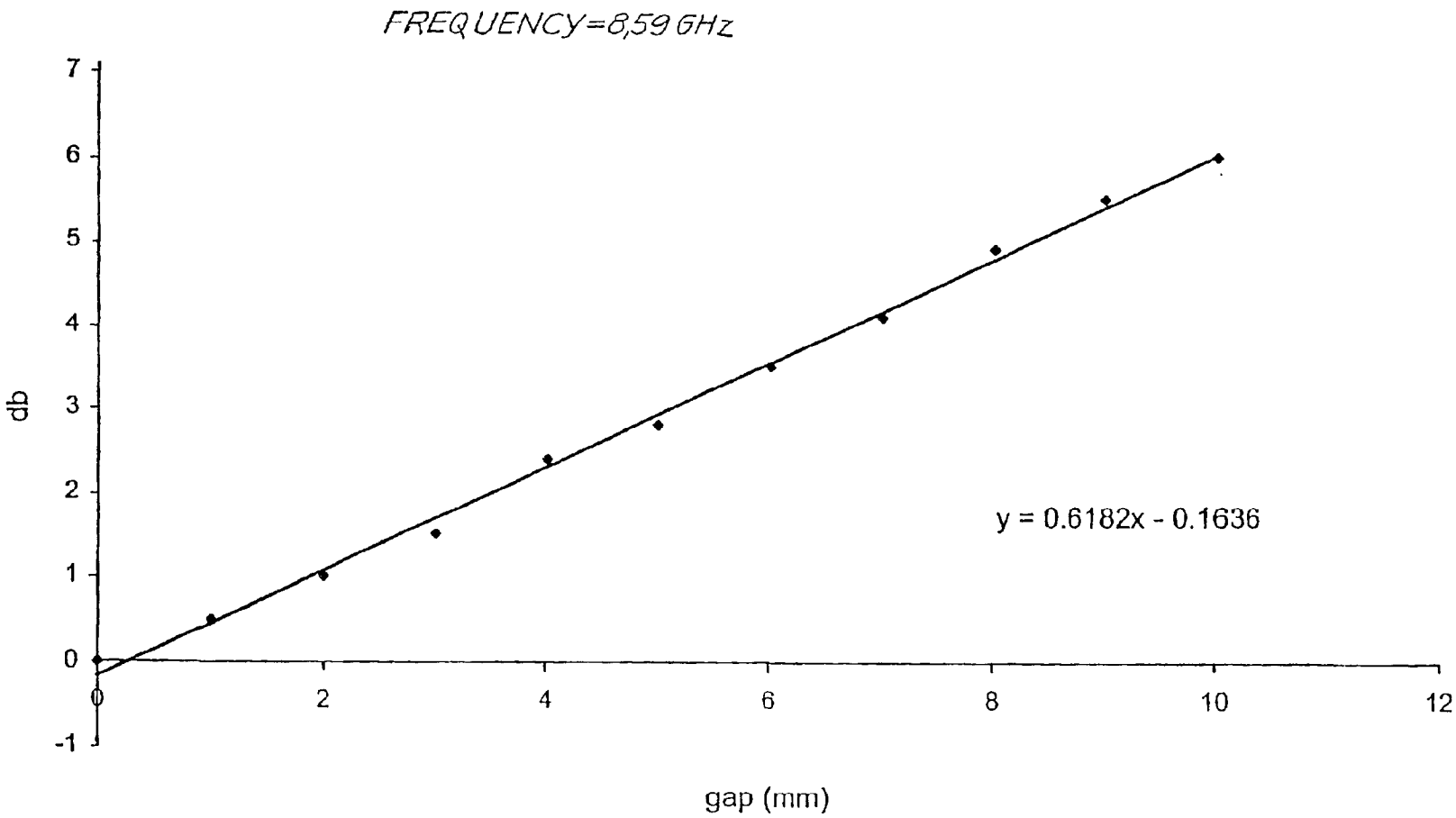

A multiplication factor of 0.8 was introduced to achieve a better fit between the theoretical curve (shown in FIG. 4) and experimental data (dashed line in FIG. 5), yielding the solid-line curve shown in FIG. 5.

It should be understood that the drawing merely illustrates an example given as a practical demonstration of the invention, while the form and arrangement of said invention could be extensively changed without leaving the scope of the concept underlying the invention. The presence of reference numbers in the attached claims is to facilitate reading the claims in reference to the description and drawing and does not limit the scope of protection represented by the claims.

What is claimed is:

1. An attenuator for rectangular wave-guides comprised of:

a first adapter with a first, variable-section component for the passage, in conditions of perfect adaptation, from a first wave-guide in a first band to a second wave-guide in a second band, and a second adapter with a second variable-section component for the passage, in conditions of perfect adaptation, from said second wave-guide to a third wave-guide in said first band; wherein:

said first and second variable-section components are positioned so that they can slide within said second wave-guide, said first and second variable-section components are mobile with respect to each other to define between them, within said second wave-guide, an empty zone with a variable longitudinal dimension, and said first and said second variable-section components each respectively present an initial, pyramidal portion extending towards said first and said third waveguides and a portion with a prismatic section corresponding to the section of the second wave-guide, the prismatic portions terminating with their respective bases orthogonal to the longitudinal axis of said second wave-guide.

2. An attenuator according to claim 1, wherein first and said second variable-section components are made of polytetrafluoroethylene.

3. An attenuator according to claim 1, wherein said first and said second variable-section components are mutually symmetrical.

4. An attenuator according to claim 1, wherein said first and said wave-guides are X-band wave-guides and said second wave-guide is a P-band wave-guide.

5. An attenuator according to claim 1, where said second wave-guide has a length of approximately 80 nm and that the empty part has a variable longitudinal length, ranging from 0 to 40 mm.

6. An attenuator according to claim 1, wherein said first and said second variable-section components respectively extend into two corresponding terminal connectors, between which said second wave-guide is inserted, the ends of which are connected to said terminal connectors.

7. An attenuator according to claim 6, wherein each of said terminal connectors has a cavity with a variable rectangular section that changes between the entrance and the exit of the connector.

8. An attenuator according to claim 6, where said second wave-guide presents a longitudinal slot through which pass members connecting said first and second variable-section components and corresponding sliders, in turn associated with adjustment means for adjusting the relative position of said first and second variable-section components.

9. An attenuator according to claim 8, wherein said adjustment means include a threaded rod with portions having threads in opposite directions and on which said two sliders are engaged.

10. A rectangular wave-guide attenuator arrangement comprising:

a first wave-guide in a first band;

a second wave-guide in a second band;

a third wave-guide in said first band;

a first adapter with a first variable-section component defining a varying section space that changes between a wave entrance and a wave exit and with wave propagation, in conditions of perfect adaptation, from said first wave-guide in said first band to said second wave-guide in said second band;

a second adapter with a second variable-section component defining a varying section space that changes between a wave entrance and a wave exit and with wave propagation, in conditions of perfect adaptation, from said second wave-guide in said second band to said third wave-guide in said first band;

support means for supporting said first and second variable-section components so that they can slide within said second wave-guide, whereby said first and second variable-section components are mobile with respect to each other to define between them, within said second wave-guide, an empty zone with a variable longitudinal dimension, wherein said first and said second variable-section components each respectively present an initial, pyramidal portion extending towards said first and said third waveguides and a portion with a prismatic section corresponding to the section of the second wave-guide, the prismatic portions terminating with their respective bases ottbogonal to the longitudinal axis of said second wave-guide.

11. An attenuator for rectangular wave-guides comprised of:

a first adapter with a first, variable-section component for the passage, in conditions of perfect adaptation, from a first wave-guide in a first band to a second wave-guide in a second band, and a second adapter with a second variable-section component for the passage, in conditions of perfect adaptation, from said second wave-guide to a third wave-guide in said first band; wherein:

said first and second variable-section components are positioned so that they can slide within said second wave-guide, said first and second variable-section components are mobile with respect to each other to define between them, within said second wave-guide, an empty zone with a variable longitudinal dimension, said second wave-guide presents a longitudinal slot through which pass members connecting said first and second variable-section components and corresponding sliders, in turn associated with adjustment means for adjusting the relative position of said first and second variable-section components, and said adjustment means include a threaded rod with portions having threads in opposite directions and on which said two sliders are engaged.

* * * * *